US008540037B2

(12) United States Patent
Hall

(10) Patent No.: US 8,540,037 B2
(45) Date of Patent: Sep. 24, 2013

(54) LAYERED POLYCRYSTALLINE DIAMOND

(75) Inventor: David R. Hall, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 402 days.

(21) Appl. No.: 12/112,099

(22) Filed: Apr. 30, 2008

(65) Prior Publication Data

US 2009/0273224 A1 Nov. 5, 2009

(51) Int. Cl.
*E21B 10/46* (2006.01)

(52) U.S. Cl.
USPC ..... 175/433; 175/434; 175/426

(58) Field of Classification Search
USPC ..... 299/111, 113, 100, 101, 110, 112 R, 299/112 T; 175/374, 425, 426, 428, 435, 175/434, 430, 433
See application file for complete search history.

(56) References Cited

U.S. PATENT DOCUMENTS

| | | | |
|---|---|---|---|
| 465,103 | A | 12/1891 | Wegner |
| 616,118 | A | 12/1898 | Kunhe |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,387,733 | A | 8/1921 | Midgett |
| 1,460,671 | A | 7/1923 | Hebsacker |
| 1,544,757 | A | 7/1925 | Hufford et al. |
| 1,821,474 | A | 9/1931 | Mercer |
| 1,879,177 | A | 9/1932 | Gault |
| 2,004,315 | A | 6/1935 | Fean |
| 2,054,255 | A | 9/1936 | Howard |
| 2,064,255 | A | 12/1936 | Garfield |
| 2,124,438 | A | 7/1938 | Struk et al. |
| 2,169,223 | A | 8/1939 | Christian |
| 2,218,130 | A | 10/1940 | Court |
| 2,320,136 | A | 5/1943 | Kammerer |
| 2,466,991 | A | 4/1949 | Kammerer |
| 2,540,464 | A | 2/1951 | Stokes |
| 2,544,036 | A | 3/1951 | Kammerer |

(Continued)

FOREIGN PATENT DOCUMENTS

| | | |
|---|---|---|
| DE | 33 07 910 | 9/1984 |
| DE | 3500261 | 7/1986 |

(Continued)

OTHER PUBLICATIONS

Chaturvedi et al., Diffusion Brazing of Cast Inconel 738 Superalloy, Sep. 2005, Journal of Materials Online (http://www.azom.com/details.asp?ArticleID=2995).

(Continued)

*Primary Examiner* — Sunil Singh
(74) *Attorney, Agent, or Firm* — Osha Liang LLP

(57) ABSTRACT

In one aspect of the present invention, a high impact wear resistant tool has a superhard material bonded to a cemented metal carbide substrate at a non-planar interface. The superhard material has a thickness of at least 0.100 inch and forms an included angle of 35 to 55 degrees. The superhard material has a plurality of substantially distinct diamond layers. Each layer of the plurality of layers has a different catalyzing material concentration. A diamond layer adjacent the substrate of the superhard material has a higher catalyzing material concentration than a diamond layer at a distal end of the superhard material.

22 Claims, 6 Drawing Sheets

(56) References Cited

U.S. PATENT DOCUMENTS 2,755,071 A 7/1956 Kammerer
2,776,819 A 1/1957 Brown
2,819,043 A 1/1958 Henderson
2,838,284 A 6/1958 Austin
2,894,722 A 7/1959 Buttolph
2,901,223 A 8/1959 Scott
2,963,102 A 12/1960 Smith
3,135,341 A 6/1964 Ritter
3,254,392 A 6/1966 Novkov
3,294,186 A 12/1966 Buell
3,301,339 A 1/1967 Pennebaker, Jr.
3,379,264 A 4/1968 Cox
3,397,012 A 8/1968 Krekeler
3,429,390 A 2/1969 Bennett
3,493,165 A 2/1970 Schonfeld
3,583,504 A 6/1971 Aaulund
3,626,775 A 12/1971 Gentry
3,745,396 A 7/1973 Quintal et al.
3,745,623 A 7/1973 Wentorf, Jr. et al.
3,746,396 A 7/1973 Radd
3,764,493 A 10/1973 Rosar et al.
3,800,891 A 4/1974 White et al.
3,807,804 A 4/1974 Kniff
3,821,993 A 7/1974 Kniff et al.
3,830,321 A 8/1974 McKenry et al.
3,932,952 A 1/1976 Helton
3,945,681 A 3/1976 White
3,955,635 A 5/1976 Skidmore
3,960,223 A 6/1976 Kleine
4,005,914 A 2/1977 Newman
4,006,936 A 2/1977 Crabiel
4,081,042 A 3/1978 Johnson et al.
4,096,917 A 6/1978 Harris
4,098,362 A 7/1978 Bonnice
4,106,577 A 8/1978 Summers
4,109,737 A 8/1978 Bovenkerk
4,140,004 A 2/1979 Smith et al.
4,156,329 A 5/1979 Daniels
4,176,723 A 12/1979 Arceneaux
4,199,035 A 4/1980 Thompson
4,201,421 A 5/1980 Den Besten
4,211,508 A 7/1980 Dill et al.
4,224,380 A 9/1980 Bovenkerk et al.
4,253,533 A 3/1981 Baker, III
4,268,089 A 5/1981 Spence et al.
4,277,106 A 7/1981 Sahley
4,280,573 A 7/1981 Sudnishnikov et al.
4,304,312 A 12/1981 Larsson
4,307,786 A 12/1981 Evans
D264,217 S 5/1982 Prause et al.
4,333,902 A 6/1982 Hara
4,333,986 A 6/1982 Tsuji et al.
4,337,980 A 7/1982 Krekeler
4,390,992 A 6/1983 Judd
4,397,361 A 8/1983 Langford, Jr.
4,412,980 A 11/1983 Tsuji et al.
4,416,339 A 11/1983 Baker et al.
4,425,315 A 1/1984 Tsuji et al.
4,439,250 A 3/1984 Acharya et al.
4,445,580 A 5/1984 Sahley
4,448,269 A 5/1984 Ishikawa et al.
4,465,221 A 8/1984 Schmidt
4,481,016 A 11/1984 Campbell et al.
4,484,644 A 11/1984 Cook et al.
4,484,783 A 11/1984 Emmerich
4,489,986 A 12/1984 Dziak
4,499,795 A 2/1985 Radtke
4,525,178 A 6/1985 Hall
4,531,592 A 7/1985 Hayatdavoudi
4,535,853 A 8/1985 Ippolito et al.
4,538,691 A 9/1985 Dennis
4,566,545 A 1/1986 Story et al.
4,574,895 A 3/1986 Dolezal et al.
4,599,731 A 7/1986 Ware et al.
4,604,106 A * 8/1986 Hall ..... 51/293
4,627,503 A 12/1986 Horton
4,636,253 A 1/1987 Nakai et al.
4,636,353 A 1/1987 Seon
4,640,374 A 2/1987 Dennis
4,647,111 A 3/1987 Bronder et al.
4,647,546 A 3/1987 Hall, Jr. et al.
4,650,776 A 3/1987 Cerceau et al.
4,662,348 A 5/1987 Hall et al.
4,664,705 A 5/1987 Horton et al.
4,678,237 A 7/1987 Collin
4,682,987 A 7/1987 Brady
4,684,176 A 8/1987 Den Besten et al.
4,688,856 A 8/1987 Elfgen
4,690,691 A 9/1987 Komanduri
4,694,918 A * 9/1987 Hall ..... 175/430
4,725,098 A 2/1988 Beach
4,726,718 A 2/1988 Meskin et al.
4,729,440 A 3/1988 Hall
4,729,603 A 3/1988 Elfgen
4,765,686 A 8/1988 Adams
4,765,687 A 8/1988 Parrott
4,776,862 A 10/1988 Wiand
4,852,672 A 8/1989 Behrens
4,880,154 A 11/1989 Tank
4,889,017 A 12/1989 Fuller et al.
D305,871 S 2/1990 Geiger
4,921,310 A 5/1990 Hedlund et al.
4,932,723 A 6/1990 Mills
4,940,099 A * 7/1990 Deane et al. ..... 175/374
4,940,288 A 7/1990 Stiffler et al.
4,944,559 A 7/1990 Sionnet
4,944,772 A 7/1990 Cho
4,951,762 A 8/1990 Lundell
4,954,139 A * 9/1990 Cerutti ..... 51/293
4,956,238 A 9/1990 Griffin
4,962,822 A 10/1990 Pascale
4,981,184 A 1/1991 Knowlton et al.
5,007,685 A 4/1991 Beach et al.
5,009,273 A 4/1991 Grabinski
5,011,515 A 4/1991 Frushour
5,027,914 A 7/1991 Wilson
5,030,250 A * 7/1991 Burnand et al. ..... 51/293
5,038,873 A 8/1991 Jurgens
D324,056 S 2/1992 Frazee
D324,226 S 2/1992 Frazee
5,088,797 A 2/1992 O'Neill
5,101,691 A * 4/1992 Barr ..... 76/108.2
5,112,165 A 5/1992 Hedlund et al.
5,119,714 A 6/1992 Scott et al.
5,119,892 A 6/1992 Clegg et al.
5,141,063 A 8/1992 Quesenbury
5,141,289 A 8/1992 Stiffler
D329,809 S 9/1992 Bloomfield
5,154,245 A 10/1992 Waldenstrom
5,186,268 A 2/1993 Clegg
5,186,892 A 2/1993 Pope
5,222,566 A 6/1993 Taylor et al.
5,248,006 A 9/1993 Scott et al.
5,251,964 A 10/1993 Ojanen
5,255,749 A 10/1993 Bumpurs et al.
5,261,499 A 11/1993 Grubb
5,265,682 A 11/1993 Russell et al.
D342,268 S 12/1993 Meyer
5,303,984 A 4/1994 Ojanen
5,304,342 A 4/1994 Hall, Jr. et al.
5,332,348 A 7/1994 Lemelson
5,351,770 A 10/1994 Cawthorne et al.
5,361,859 A 11/1994 Tibbitts
5,374,319 A 12/1994 Stueber et al.
D357,485 S 4/1995 Mattsson et al.
5,410,303 A 4/1995 Comeau et al.
5,417,292 A 5/1995 Polakoff
5,417,475 A 5/1995 Graham
5,423,389 A 6/1995 Warren et al.
5,447,208 A 9/1995 Lund
5,494,477 A 2/1996 Flood et al.
5,507,357 A 4/1996 Hult et al.
D371,374 S 7/1996 Fischer et al.
5,533,582 A 7/1996 Tibbitts 5,535,839 A 7/1996 Brady
5,542,993 A 8/1996 Rabinkin
5,544,713 A 8/1996 Dennis
5,560,440 A 10/1996 Tibbitts
5,568,838 A 10/1996 Struthers et al.
5,653,300 A 8/1997 Lund
5,655,614 A 8/1997 Azar
5,662,720 A 9/1997 O'Tigheamaigh
5,678,644 A 10/1997 Fielder
5,709,279 A 1/1998 Dennis
5,720,528 A 2/1998 Ritchey
5,732,784 A 3/1998 Nelson
5,738,698 A 4/1998 Kapoor et al.
5,794,728 A 8/1998 Palmberg
5,811,944 A 9/1998 Sampayan et al.
5,823,632 A 10/1998 Burkett
5,837,071 A 11/1998 Andersson et al.
5,845,547 A 12/1998 Sollami
5,848,657 A 12/1998 Flood
5,871,060 A 2/1999 Jensen et al.
5,875,862 A 3/1999 Jurewicz
5,884,979 A 3/1999 Latham
5,890,552 A 4/1999 Scott et al.
5,896,938 A 4/1999 Moeny et al.
5,914,055 A 6/1999 Roberts et al.
5,934,542 A 8/1999 Nakamura et al.
5,935,718 A 8/1999 Demo et al.
5,944,129 A 8/1999 Jensen
5,947,215 A 9/1999 Lundell
5,950,743 A 9/1999 Cox
5,957,223 A 9/1999 Doster et al.
5,957,225 A 9/1999 Sinor
5,967,247 A 10/1999 Pessier
5,967,250 A 10/1999 Lund
5,979,571 A 11/1999 Scott et al.
5,992,405 A 11/1999 Sollami
5,992,547 A 11/1999 Caraway et al.
5,992,548 A 11/1999 Silva et al.
6,000,483 A 12/1999 Jurewicz et al.
6,003,623 A 12/1999 Meiss
6,006,846 A 12/1999 Tibbitts
6,018,729 A 1/2000 Zacharia et al.
6,019,434 A 2/2000 Emmerich
6,021,859 A 2/2000 Tibbitts et al.
6,039,131 A 3/2000 Beaton
6,041,875 A 3/2000 Rai et al.
6,044,920 A 4/2000 Massa
6,051,079 A 4/2000 Andersson et al.
6,056,911 A 5/2000 Griffin
6,065,552 A 5/2000 Scott et al.
6,068,913 A 5/2000 Cho et al.
6,098,730 A 8/2000 Scott et al.
6,113,195 A 9/2000 Mercier
6,131,675 A 10/2000 Anderson
6,150,822 A 11/2000 Hong et al.
6,170,917 B1 1/2001 Heinrich
6,186,251 B1 2/2001 Butcher
6,193,770 B1 2/2001 Sung
6,196,340 B1 3/2001 Jensen
6,196,636 B1 3/2001 Mills
6,196,910 B1 3/2001 Johnson
6,199,645 B1 * 3/2001 Anderson et al. ..... 175/426
6,199,956 B1 3/2001 Kammerer
6,202,761 B1 3/2001 Forney
6,202,770 B1 * 3/2001 Jurewicz et al. ..... 175/428
6,213,226 B1 4/2001 Eppink et al.
6,216,805 B1 4/2001 Lays
6,220,375 B1 4/2001 Butcher et al.
6,220,376 B1 * 4/2001 Lundell ..... 175/430
6,223,824 B1 5/2001 Moyes
6,223,974 B1 5/2001 Unde
6,257,673 B1 7/2001 Markham et al.
6,258,139 B1 7/2001 Jensen
6,260,639 B1 7/2001 Yong et al.
6,269,893 B1 8/2001 Beaton et al.
6,270,165 B1 8/2001 Peay
6,272,748 B1 8/2001 Smyth
6,290,008 B1 9/2001 Portwood et al.
6,296,069 B1 10/2001 Lamine et al.
6,302,224 B1 10/2001 Sherwood, Jr.
6,302,225 B1 10/2001 Yoshida et al.
6,315,065 B1 * 11/2001 Yong et al. ..... 175/428
6,332,503 B1 12/2001 Pessier et al.
6,340,064 B2 1/2002 Fielder et al.
6,341,823 B1 1/2002 Sollami
6,354,771 B1 3/2002 Bauschulte
6,364,034 B1 4/2002 Schoeffler
6,364,420 B1 4/2002 Sollami
6,371,567 B1 4/2002 Sollami
6,375,272 B1 4/2002 Ojanen
6,375,706 B2 4/2002 Kembaiyan et al.
6,394,200 B1 5/2002 Watson et al.
6,408,052 B1 6/2002 McGeoch
6,408,959 B2 6/2002 Bertagnolli et al.
6,419,278 B1 7/2002 Cunningham
6,429,398 B1 8/2002 Legoupil et al.
6,439,326 B1 8/2002 Huang et al.
6,460,637 B1 10/2002 Siracki et al.
6,468,368 B1 10/2002 Merrick et al.
6,474,425 B1 11/2002 Truax et al.
6,478,383 B1 11/2002 Ojanen
6,481,803 B2 11/2002 Ritchey
6,484,825 B2 11/2002 Watson et al.
6,484,826 B1 11/2002 Anderson et al.
6,499,547 B2 12/2002 Scott
6,508,318 B1 1/2003 Linden
6,510,906 B1 1/2003 Richert et al.
6,513,606 B1 2/2003 Krueger
6,517,902 B2 2/2003 Drake
6,533,050 B2 3/2003 Molloy
6,561,293 B2 5/2003 Minikus et al.
6,562,462 B2 5/2003 Griffin et al.
D477,225 S 7/2003 Pinnavaia
6,585,326 B2 7/2003 Sollami
6,592,985 B2 7/2003 Griffin et al.
6,594,881 B2 7/2003 Tibbitts
6,596,225 B1 7/2003 Pope
6,601,454 B1 8/2003 Botnan
6,601,662 B2 8/2003 Matthias et al.
6,622,803 B2 9/2003 Harvey
6,668,949 B1 12/2003 Rives
6,672,406 B2 1/2004 Beuerschausen
6,685,273 B1 2/2004 Sollami
6,692,083 B2 2/2004 Latham
6,702,393 B2 3/2004 Mercier
6,709,065 B2 3/2004 Peay
6,711,060 B2 3/2004 Sakakibara
6,719,074 B2 4/2004 Tsuda
6,729,420 B2 5/2004 Mensa-Wilmot
6,732,817 B2 5/2004 Dewey et al.
6,732,914 B2 5/2004 Cadden et al.
6,733,087 B2 5/2004 Hall
6,739,327 B2 5/2004 Sollami
6,749,033 B2 6/2004 Griffin et al.
6,758,530 B2 7/2004 Sollami
D494,031 S 8/2004 Moore, Jr.
D494,064 S 8/2004 Hook
6,786,557 B2 9/2004 Montgomery, Jr.
6,802,676 B2 10/2004 Noggle
6,822,579 B2 11/2004 Goswami et al.
6,824,225 B2 11/2004 Stiffler
6,846,045 B2 1/2005 Sollami
6,851,758 B2 2/2005 Beach
6,854,810 B2 2/2005 Montgomery, Jr.
6,861,137 B2 3/2005 Griffin et al.
6,878,447 B2 4/2005 Griffin
6,880,744 B2 4/2005 Noro et al.
6,889,890 B2 5/2005 Yamazaki et al.
6,929,076 B2 8/2005 Fanuel et al.
6,933,049 B2 8/2005 Wan et al.
6,953,096 B2 10/2005 Gledhill et al.
6,959,765 B2 11/2005 Bell
6,962,395 B2 11/2005 Mouthaan
6,966,611 B1 11/2005 Sollami
6,994,404 B1 2/2006 Sollami
7,048,081 B2 5/2006 Smith et al.
7,152,703 B2 12/2006 Meiners et al.
7,204,560 B2 4/2007 Mercier

| | | | | |
|---|---|---|---|---|
| D547,652 | S | 7/2007 | Kerman et al. | |
| D560,699 | S | 1/2008 | Omi | |
| 7,350,601 | B2 | 4/2008 | Belnap et al. | |
| 7,377,341 | B2 | 5/2008 | Middlemiss et al. | |
| 7,380,888 | B2 | 6/2008 | Ojanen | |
| 7,396,086 | B1 * | 7/2008 | Hall et al. | 299/113 |
| 7,543,662 | B2 | 6/2009 | Belnap et al. | |
| 7,575,425 | B2 | 8/2009 | Hall et al. | |
| 7,592,077 | B2 | 9/2009 | Gates, Jr. et al. | |
| 7,665,552 | B2 | 2/2010 | Hall | |
| 7,703,559 | B2 | 4/2010 | Shen et al. | |
| 7,730,977 | B2 | 6/2010 | Achilles | |
| 7,757,785 | B2 | 7/2010 | Zhang et al. | |
| 7,798,258 | B2 | 9/2010 | Singh et al. | |
| 2001/0004946 | A1 | 6/2001 | Jensen | |
| 2002/0074851 | A1 | 6/2002 | Montgomery, Jr. | |
| 2002/0153175 | A1 | 10/2002 | Ojanen | |
| 2002/0175555 | A1 | 11/2002 | Mercier | |
| 2003/0044800 | A1 | 3/2003 | Connelly et al. | |
| 2003/0079565 | A1 | 5/2003 | Liang et al. | |
| 2003/0141350 | A1 | 7/2003 | Noro et al. | |
| 2003/0209366 | A1 | 11/2003 | McAlvain | |
| 2003/0213621 | A1 | 11/2003 | Britten | |
| 2003/0217869 | A1 | 11/2003 | Snyder et al. | |
| 2003/0234280 | A1 | 12/2003 | Cadden | |
| 2004/0026132 | A1 | 2/2004 | Hall | |
| 2004/0026983 | A1 | 2/2004 | McAlvain | |
| 2004/0065484 | A1 | 4/2004 | McAlvain | |
| 2004/0155096 | A1 | 8/2004 | Zimmerman et al. | |
| 2004/0238221 | A1 | 12/2004 | Ruina et al. | |
| 2004/0256155 | A1 | 12/2004 | Kriesels | |
| 2004/0256442 | A1 | 12/2004 | Gates, Jr. et al. | |
| 2005/0044800 | A1 | 3/2005 | Hall | |
| 2005/0159840 | A1 | 7/2005 | Lin et al. | |
| 2005/0173966 | A1 | 8/2005 | Mouthaan | |
| 2005/0263327 | A1 | 12/2005 | Meiners et al. | |
| 2006/0060391 | A1 | 3/2006 | Eyre et al. | |
| 2006/0086537 | A1 | 4/2006 | Dennis | |
| 2006/0086540 | A1 | 4/2006 | Griffin | |
| 2006/0162969 | A1 * | 7/2006 | Belnap et al. | 175/433 |
| 2006/0180354 | A1 * | 8/2006 | Belnap et al. | 175/374 |
| 2006/0186724 | A1 | 8/2006 | Stehney | |
| 2006/0237236 | A1 | 10/2006 | Sreshta | |
| 2007/0193782 | A1 | 8/2007 | Fang et al. | |
| 2007/0278017 | A1 | 12/2007 | Shen et al. | |
| 2008/0006448 | A1 | 1/2008 | Zhang et al. | |
| 2008/0053710 | A1 | 3/2008 | Moss | |
| 2008/0073126 | A1 | 3/2008 | Shen et al. | |
| 2008/0073127 | A1 | 3/2008 | Zhan et al. | |
| 2008/0142276 | A1 | 6/2008 | Griffo et al. | |
| 2008/0156544 | A1 | 7/2008 | Singh et al. | |
| 2008/0206576 | A1 * | 8/2008 | Qian et al. | 428/446 |
| 2008/0264696 | A1 * | 10/2008 | Dourfaye et al. | 175/428 |

FOREIGN PATENT DOCUMENTS

| | | |
|---|---|---|
| DE | 3818213 | 11/1989 |
| DE | 4039217 | 6/1992 |
| DE | 19821147 | 11/1999 |
| DE | 10163717 | 5/2003 |
| EP | 0295151 | 12/1988 |
| EP | 0412287 | 7/1990 |
| GB | 2004315 | 3/1979 |
| GB | 2037223 | 11/1979 |
| JP | 5280273 | 10/1993 |
| SU | 1418463 A * | 8/1988 |

OTHER PUBLICATIONS

International search report for PCT/US2007/075670.

International Report on Patentability Chapter I for PCT/US07/75670, mailed Nov. 17, 2008, 6 pages.

International Preliminary Report on Patentability Chapter II for PCT/US07/75670, completed Aug. 24, 2009, 4 pages.

* cited by examiner

LAYERED POLYCRYSTALLINE DIAMOND

BACKGROUND OF THE INVENTION

The present invention relates to high impact wear resistant tools that may be used in machinery such as crushers, picks, grinding mills, roller cone bits, rotary fixed cutter bits, earth boring bits, percussion bits or impact bits, and drag bits. More particularly, the invention relates to inserts having a carbide substrate with a non-planar interface, and an abrasion resistant layer of superhard material affixed thereto using a high pressure high temperature press apparatus. Such inserts typically shave a superhard material layer or layers formed under high temperature and pressure conditions. The high temperature and pressure conditions typically occur in a press apparatus designed to create such conditions. The superhard material layer or layers may be cemented to a carbide substrate. The carbide substrate may contain a metal binder or catalyst such as cobalt. The carbide substrate is often softer than the superhard material bonded to the carbide substrate. Some examples of superhard materials that high-temperature, high-pressure (HTHP) presses may produce and sinter include cemented ceramics, diamond, polycrystalline diamond (PCD), and cubic boron nitride.

An insert is normally fabricated by placing a cemented carbide substrate into a container or cartridge with a layer of diamond crystals or grains loaded into the cartridge adjacent a face of the substrate. A number of such cartridges are typically loaded into a reaction cell and placed in the HTHP press apparatus. The cemented carbide substrates and adjacent diamond crystals are then compressed under HTHP conditions, which promotes a sintering of the diamond grains to form a PCD structure. As a result, the diamond grains become mutually bonded to form a superhard material layer over the substrate interface and the resulting superhard layer is also bonded to the substrate interface.

Such inserts are often subjected to intense forces, torques, vibration, high temperatures and temperature differentials during operation. As a result, stresses within the structure may begin to form. Drill bits, for example, may exhibit stresses aggravated by drilling anomalies during well boring operations, such as bit whirl or bounce often resulting in spalling, delamination, or fracture of the superhard material or the substrate thereby reducing or eliminating the insert's efficacy and decreasing overall drill bit wear life. The superhard material of an insert sometimes delaminates from the carbide substrate after the sintering process as well as during percussive and abrasive use. Damage typically found in percussive and drag bits may be a result of shear failures, although non-shear modes of failure are not uncommon. The interface between the superhard material and substrate is particularly susceptible to non-shear failure modes due to inherent residual stresses.

U.S. Pat. No. 7,258,741 to Linares, et al., which is herein incorporated by reference for all that it contains, discloses synthetic monocrystalline diamond compositions having one or more monocrystalline diamond layers formed by chemical vapor deposition, the layers including one or more layers having an increased concentration of one or more impurities (such as boron and/or isotopes of carbon), as compared to other layers or comparable layers without such impurities. Such compositions provide an improved combination of properties, including color, strength, velocity of sound, electrical conductivity, and control of defects. A related method for preparing such a composition is also described, as well as a system for use in performing such a method, and articles incorporating such a composition.

U.S. Pat. No. 6,562,462 to Griffin, et al., which is herein incorporated by reference for all that it contains, discloses a PCD or a diamond-like element with greatly improved wear resistance without loss of impact strength. These elements are formed with a binder-catalyzing material in a HTHP process. The PCD element has a body with a plurality of bonded diamond or diamond-like crystals forming a continuous diamond matrix that has a diamond volume density greater than 85%. Interstices among the diamond crystals form a continuous interstitial matrix containing a catalyzing material. The diamond matrix table is formed and integrally bonded with a metallic substrate containing the catalyzing material during the HTHP process. The diamond matrix body has a working surface, where a portion of the interstitial matrix in the body adjacent to the working surface is substantially free of the catalyzing material, and the remaining interstitial matrix contains the catalyzing material. Typically, less than about 70% of the body of the diamond matrix table is free of the catalyzing material.

BRIEF SUMMARY OF THE INVENTION

In one aspect of the present invention, a high impact wear resistant tool has a superhard material bonded to a substrate at a non-planar interface. The superhard material has a thickness of at least 0.100 inch and forms an included angle of 35 to 55 degrees. The superhard material has a plurality of substantially distinct diamond layers. Each layer of the plurality of layers has a different catalyzing material concentration. A diamond layer adjacent the substrate of the superhard material has a higher catalyzing material concentration than a diamond layer at a distal end of the superhard material.

The plurality of layers may comprise a varying layer thickness or a uniform layer thickness. More specifically, the diamond layer may comprise a thickness between 0.010 and 0.100 inch. The plurality of layers may comprise various geometries including inverted cone-shaped, straight, cone-shaped, irregular, or combinations thereof. A volume of the superhard material may comprise 75 to 150 percent of a volume of the substrate. A thickness of at least one layer of the plurality of layers may be as thick as a thickness of the substrate. The diamond layer adjacent the substrate may have a catalyzing material concentration between 5 and 10 percent. The diamond layer at the distal end of the superhard material may have a catalyzing material concentration between 2 and 5 percent. The diamond layer at the distal end of the superhard material may be leached. The leached diamond layer may comprise a catalyzing material concentration of 0 to 1 percent. The superhard material may have a substantially pointed geometry with an apex having a 0.050 to 0.125 inch radius. The substantially pointed geometry may have a convex or a concave side.

The high impact wear resistant tool may be incorporated in drill bits, percussion drill bits, roller cone bits, shear bits, milling machines, indenters, mining picks, asphalt picks, cone crushers, vertical impact mills, hammer mills, jaw crushers, asphalt bits, chisels, trenching machines, or combinations thereof. The substrate may be bonded to an end of the carbide segment; the carbide segment being brazed or press fit to a steel body. The superhard material may be a PCD structure with an average grain size of 1 to 100 microns. The catalyzing material may be selected from the group consisting of cobalt, nickel, iron, titanium, tantalum, niobium, alloys thereof, and combinations thereof. The plurality of layers of the superhard material may buttress each other, thereby increasing the strength of the superhard material.

DETAILED DESCRIPTION

Figure 1:
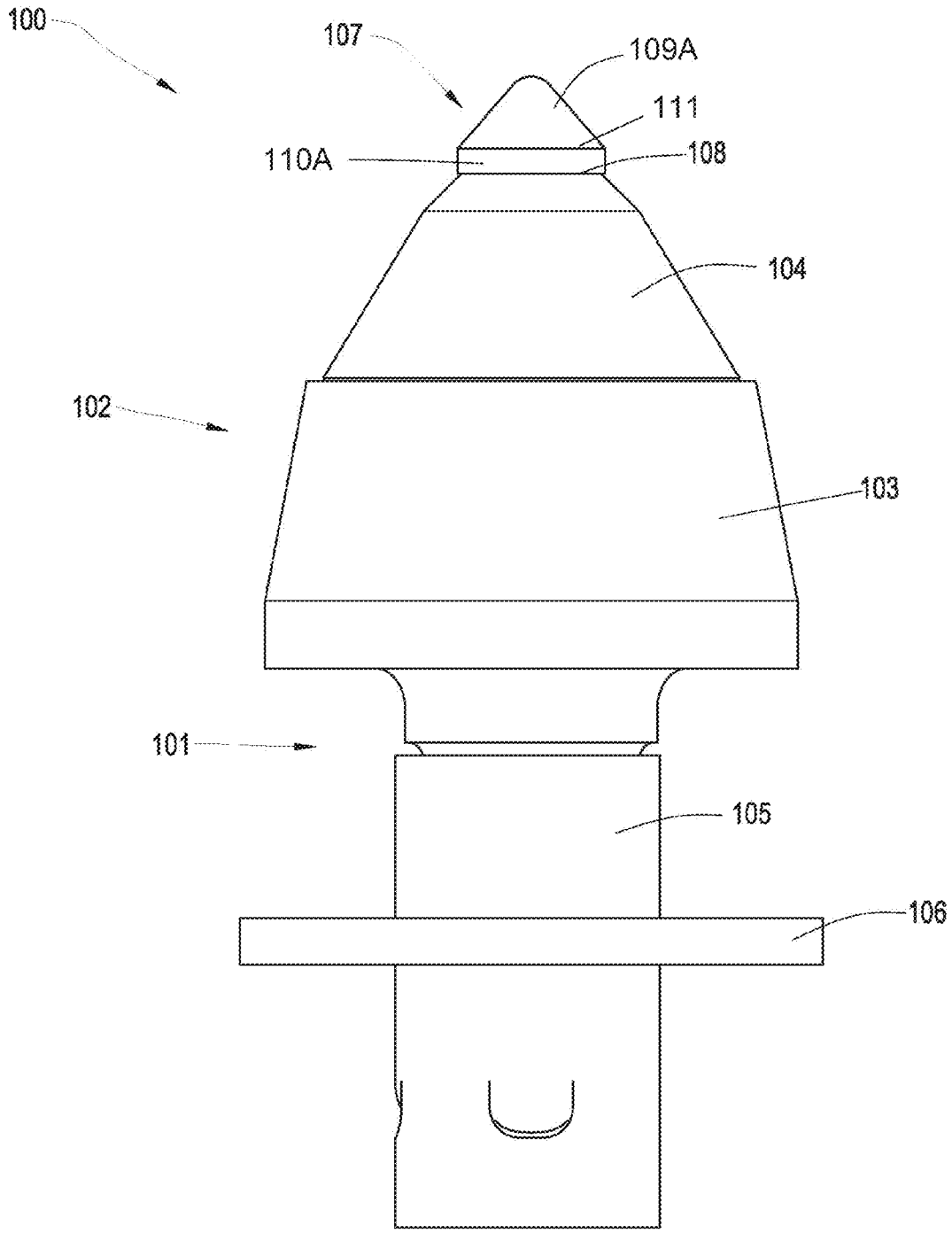
FIG. 1 is an orthogonal diagram of an embodiment of a high impact wear resistant tool.

FIG. 1 is an orthogonal diagram of an embodiment of a high impact wear resistant tool 100. The high impact, wear resistant tool 100 may be used in machines in the mining, asphalt milling, drilling, or trenching industries. The high impact, wear resistant tool 100 may comprise a shank 101 and a body 102. The body 102 may be divided into a first segment 103 and a second segment 104. The first segment 103 may generally be made of steel, while the second segment 104 may be made of a harder material such as cemented metal carbide. The second segment 104 may be bonded to the first segment 103 by brazing to prevent the second segment 104 from detaching from the first segment 103.

The shank 101 may be adapted to be attached to a driving mechanism. A protective spring sleeve 105 may be disposed around the shank 101 both for protection and to allow the high impact, wear resistant tool to be press fit into a holder (not shown) while still being able to rotate. A washer 106 may also be disposed around the shank 101 such that when the high impact, wear resistant tool 100 is inserted into the holder, the washer 106 protects an upper surface of the holder and also facilitates rotation of the high impact, wear resistant tool. The washer 106 and spring sleeve 105 may be advantageous in protecting the holder, thereby extending the life of the holder; the holder being costly to replace.

The high impact, wear resistant tool 100 further comprises a tip 107 bonded to a frustoconical end 108 of the second segment 104 of the body 102. The tip 107 has a superhard material 109A bonded to a substrate 110A at a non-planar interface 111. The tip 107 may be bonded to the substrate 110A through a HTHP process.

The superhard material 109A may be diamond, PCD, natural diamond, synthetic diamond, vapor deposited diamond, silicon bonded diamond, cobalt bonded diamond, thermally stable diamond, PCD with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, nonmetal catalyzed diamond, or combinations thereof.

The superhard material 109A may be a polycrystalline structure with an average grain size of 10 to 100 microns. The substrate 110A may comprise a 1 to 40 percent concentration of cobalt by weight, preferably 5 to 10 percent.

FIGS. 2 through 6 illustrate various embodiments of a superhard material bonded to a substrate.

Figure 2:
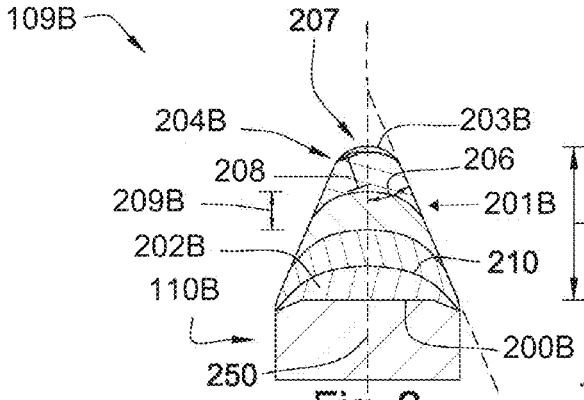
FIG. 2 is a cross-sectional diagram of an embodiment of a superhard material bonded to a substrate.

Referring now to FIG. 2, a superhard material 109B is bonded to a substrate 110B at a non-planar interface 200B. The superhard material 109B may have a plurality of substantially distinct diamond layers 201B. Each layer of the plurality of substantially distinct diamond layers 201B may have a different catalyzing material concentration. A diamond layer 202B adjacent the substrate 110B of the superhard material 109B may have a higher catalyzing material concentration than a diamond layer 203B at a distal end 204B of the superhard material 109B.

The superhard material 109B may have a thickness 205 of at least 0.100 inch and may form an included angle 206 of 35 to 55 degrees; the included angle 206 being formed between a central axis 250 of the superhard material 109B and a side of the superhard material 109B. The superhard material 109B may have a substantially pointed geometry with an apex 207 having a 0.050 to 0.125 inch radius 208. In this embodiment, the plurality of substantially distinct diamond layers 201B of the superhard material 209B may have a substantially uniform layer thickness 209B. Each of the layers may have a thickness 209B between 0.010 and 0.100 inch. The layers may also have a substantially conical-shaped geometry 210 or a rounded geometry.

Figure 3A:
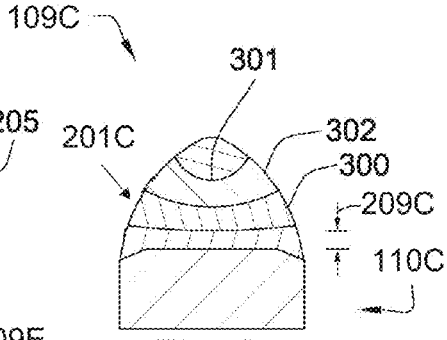
FIG. 3*a* is a cross-sectional diagram of another embodiment of a superhard material bonded to a substrate.

FIG. 3*a* illustrates another embodiment of the superhard material 109C bonded to a substrate 110C. In some embodiments, a volume of the superhard material 109C may be 75 to 150 percent of a volume of the substrate 110C. A volume of at least one layer 300 of a plurality of layers 201C may be 10 to 100 percent of the volume of the substrate 110C. In this embodiment, a thickness 209C of each of the plurality of layers 201C may vary. The plurality of layers 201C may have an inverted cone-shaped geometry 301. It is believed that this geometry may cause the plurality of layers 201C to buttress each other upon impact. In this embodiment, at least one layer may also have a substantially straight geometry. In this embodiment, the superhard material 109C may have a convex side 302. The embodiment of FIG. 3*a* also discloses the plurality of layers 201C having different types of geometries.

Figure 3B:
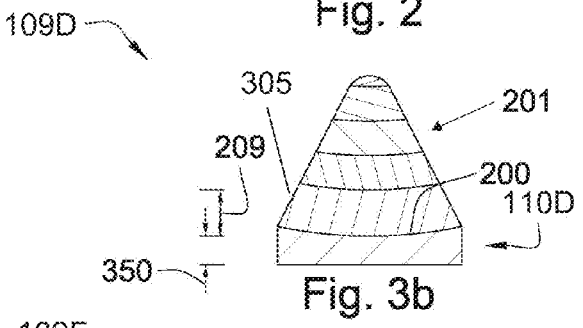
FIG. 3*b* is a cross-sectional diagram of another embodiment of a superhard material bonded to a substrate.

FIG. 3*b* shows an embodiment of the superhard material 109D bonded to a substrate 110D. The superhard material 109D has a plurality of layers 201D forming an inverted cone shaped geometry. In this embodiment, a thickness 209D of at least one of the plurality of layers 201D may be as great as a thickness 350 of the substrate 110D. A non-planer interface 200D between a first diamond layer 305 and the substrate 110D may have an inverted cone-shaped geometry.

Figure 4:
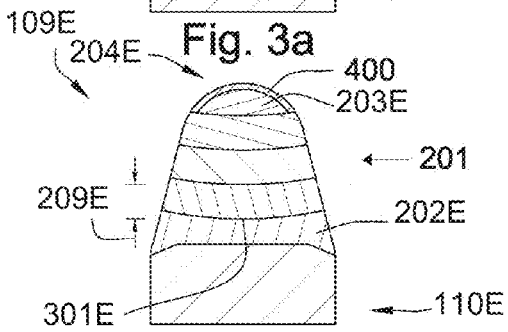
FIG. 4 is a cross-sectional diagram of another embodiment of a superhard material bonded to a substrate.

In the embodiment of FIG. 4 a superhard material 109E is bonded to a substrate 110E, A plurality of layers 201E may have an inverted cone-shaped geometry 301E and may have a substantially uniform layer thickness 209E. In some embodiments, a diamond layer 202E adjacent the substrate 110E of the superhard material 109E may have a catalyzing material concentration between 5 and 10 volume percent. A diamond layer 203E at a distal end 204E of the superhard material 109E may have a catalyzing material concentration less than that of the layer 202E adjacent the substrate 110E. The distal layer 203E may have a catalyzing material concentration between 2 and 5 volume percent. Also in this embodiment, the distal layer 203E of the superhard material 109E may be leached so that a portion 400 of the distal layer 203E may have a catalyzing material concentration of 0 to 1 percent.

Figure 5A:
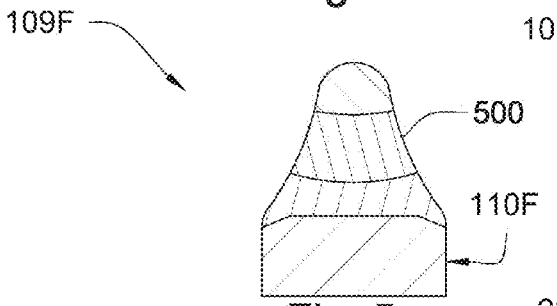
FIG. 5*a* is a cross-sectional diagram of another embodiment of a superhard material bonded to a substrate.

Referring now to FIG. 5*a*, the superhard material 109F bonded to the substrate 110F may have a concave side 500.

Figure 5B:
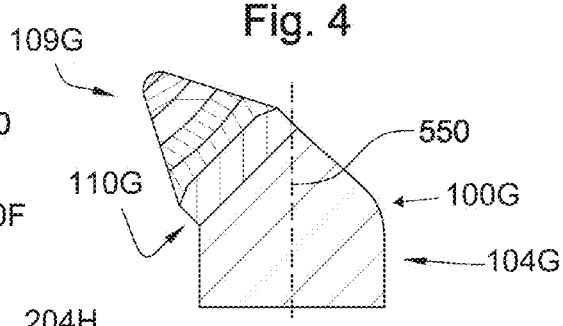
FIG. 5*b* is a cross-sectional diagram of another embodiment of a superhard material bonded to a substrate.

FIG. 5*b* illustrates an embodiment of a superhard material 109G attached to a substrate 110G. The substrate 110G is bonded to a second segment 104G of a body of a tool 100G. The substrate 110G and the superhard material 109G may be bonded at an angle with respect to a central axis 550 of the body of the tool 100G.

Figure 6:
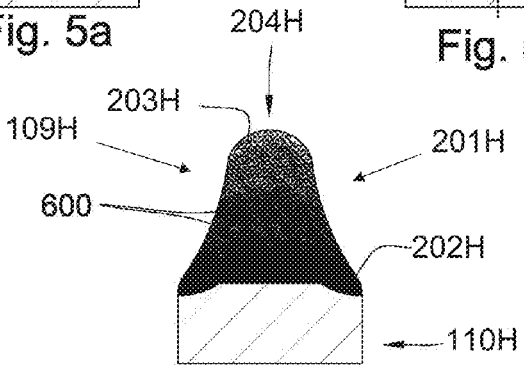
FIG. 6 is a cross-sectional diagram of another embodiment of a superhard material bonded to a substrate.

The embodiment of FIG. 6 illustrates a superhard material 109H bonded to a substrate 110H having a plurality of layers 201H; the plurality of layers 201H having different catalyzing material concentrations. The catalyzing material may be selected from the group consisting of cobalt, nickel, iron, titanium, tantalum, niobium, alloys thereof, and combinations thereof. During a HTHP process, the catalyzing material of each layer may diffuse into the surrounding layers such that the concentration of catalyzing material forms a general gradient 600 within the superhard material 109H. A diamond layer 202H adjacent the substrate 110H has a higher catalyzing material concentration than a diamond layer 203H at a distal end 204H of the superhard material 109H.

Figure 7A:
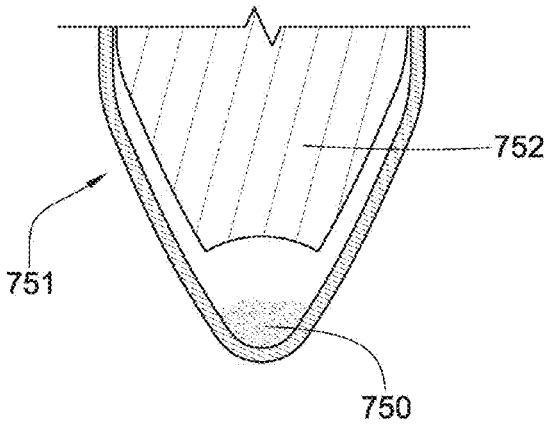
FIG. 7*a* is a cross-sectional diagram of an assembly can used to assemble an embodiment of a superhard material.
Figure 7B:
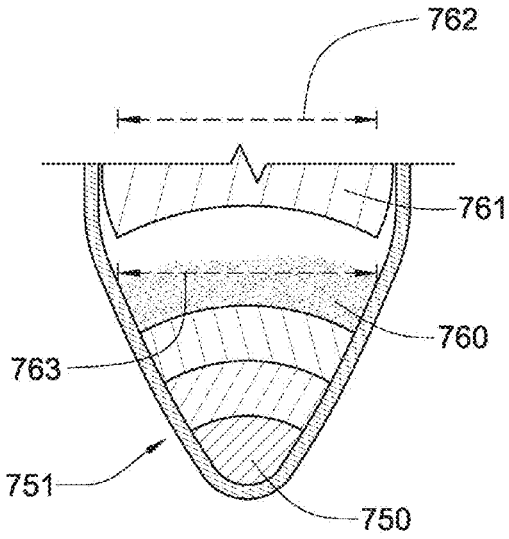
FIG. 7*b* is a cross-sectional diagram of another assembly can used to assemble another embodiment of a superhard material.
Figure 7C:
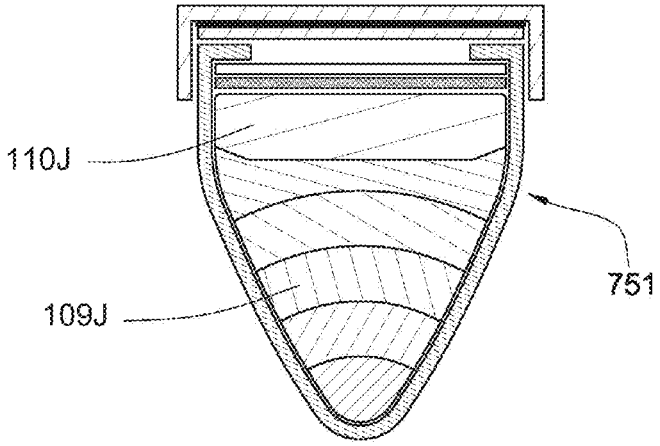
FIG. 7*c* is a cross-sectional diagram of another assembly can used to assemble an embodiment of a superhard material.

FIGS. 7*a* through 7*c* illustrate a process for assembling a superhard material such as superhard material 109A of FIG. 1 and a substrate such as substrate 110A of FIG. 1. FIG. 7*a* illustrates a first layer of diamond powder being formed into a desired geometry, the first layer corresponding to a layer at a distal end of the superhard material. FIG. 7*b* illustrates a fourth layer being formed into a desired geometry, the fourth layer corresponding to a layer adjacent a substrate. For the sake of brevity, the forming of the second and third layers is not discussed but would typically occur in a manner substantially similar to the first and fourth layer. FIG. 7*c* illustrates a completed superhard material bonded to a substrate.

In the embodiment of FIG. 7*a*, a first diamond powder layer 750 having a specific concentration of catalyzing material is inserted into a can 751; the can 751 having a desired shape of a completed superhard material. A first shaping tool 752 is then inserted into the can 751; the shaping tool 752 being adapted to form the diamond powder layer 750 into the desired geometry. In this embodiment, the desired geometry comprises an inverted cone-shape.

Referring now to FIG. 7*b*, the process of inserting an additional layer of diamond powder into the can 751 and shaping the additional layer using a shaping tool is repeated. In this embodiment, a fourth diamond layer 760 is being shaped using a fourth shaping tool 761. The fourth diamond layer 760 comprises a higher catalyzing material concentration than the first diamond layer 750. The size of the shaping tool also increases as the number of layers increases so that the shaping tool may have an end diameter 762 equal to the respective inside diameter 763 of the can 751.

FIG. 7*c* illustrates the can 751 holding an assembled superhard material 109J and substrate 110J.

The high impact, wear resistant tool may be incorporated in drill bits, percussion drill bits, roller cone bits, shear bits, milling machines, indenters, mining picks, asphalt picks, cone crushers, vertical impact mills, hammer mills, jaw crushers, asphalt bits, chisels, trenching machines, or combinations thereof. FIGS. 8 through 13 illustrate various applications in which the high impact, wear resistant tool of the present invention may be incorporated.

Figure 8:
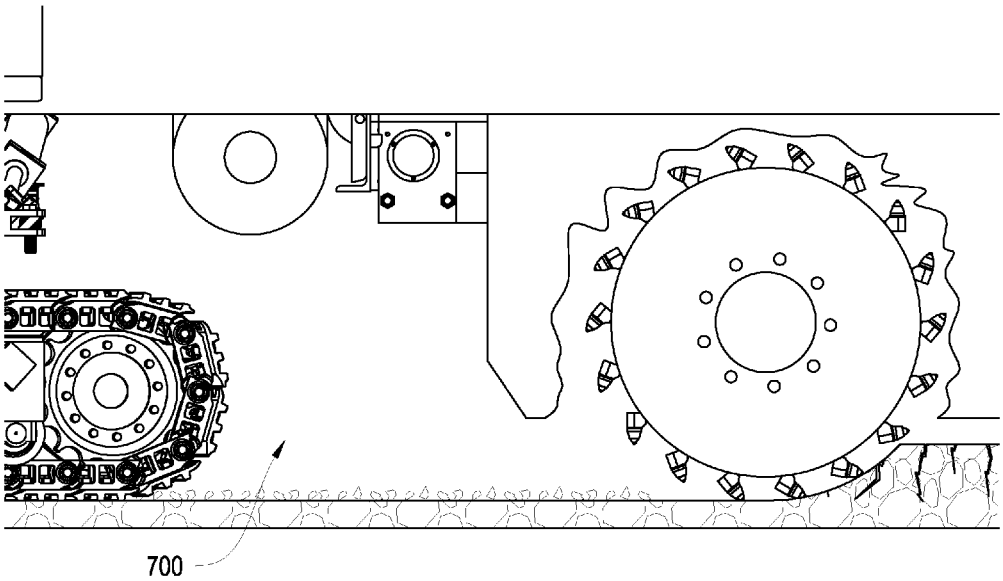
FIG. 8 is a orthogonal diagram of an embodiment of an asphalt milling machine.

Referring now to FIG. 8, the tool may be a pick in an asphalt milling machine 700.

Figure 9:
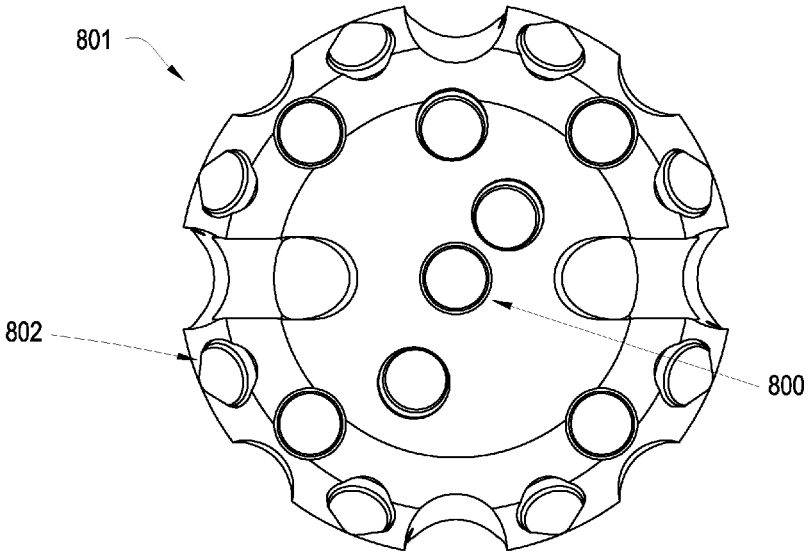
FIG. 9 is an orthogonal diagram of an embodiment of a percussion bit.
Figure 10:
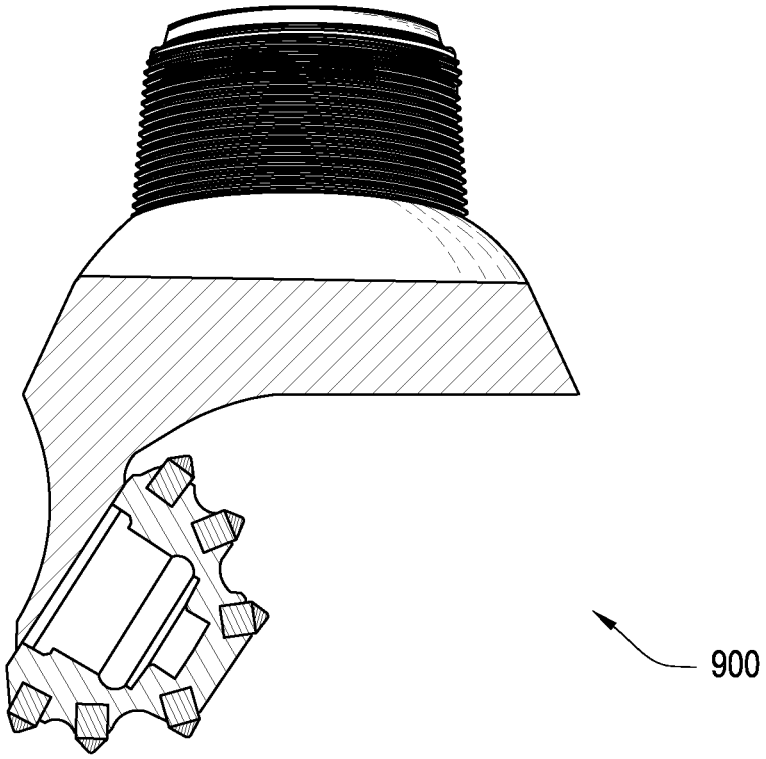
FIG. 10 is a cross-sectional diagram of an embodiment of a roller cone bit.

As shown in FIG. 9 through FIG. 12, the tool may also be an insert in a drill bit. In percussion bits, as illustrated in FIG. 9, the pointed geometry of a tool may be useful in central locations 800 on a bit face 801 or at a gauge 802 of the bit face 801. FIG. 10 shows that a pointed layered diamond bit incorporating a tool may be useful in roller cone bits 900, wherein the inserts typically fail the formation through compression. The layered diamond bits may be angled to enlarge the gauge well bore.

Figure 11:
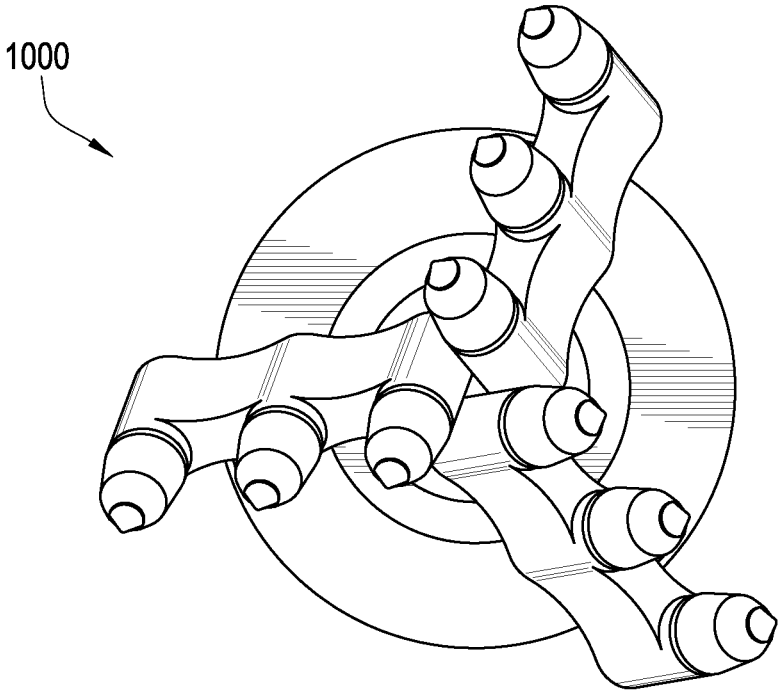
FIG. 11 is an orthogonal diagram of an embodiment of a mining bit.

FIG. 11 discloses a mining bit 1000 that may also be incorporated with the present invention.

Figure 12:
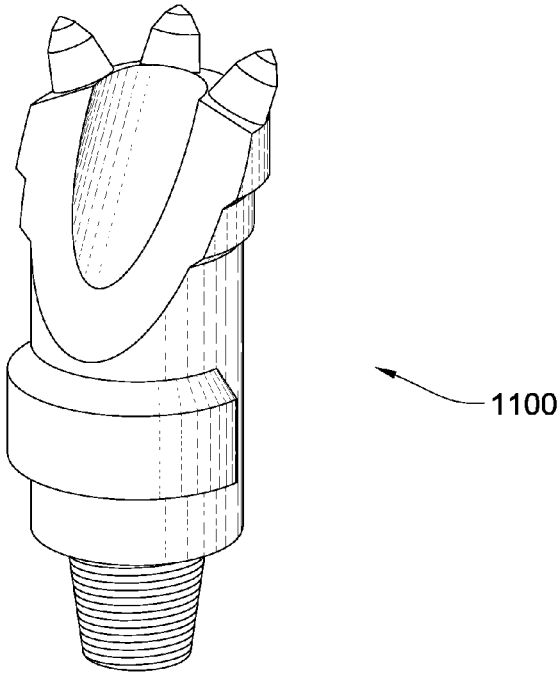
FIG. 12 is a perspective diagram of an embodiment of a drill bit.

FIG. 12 discloses a drill bit 1100 typically used in horizontal drilling.

Figure 13:
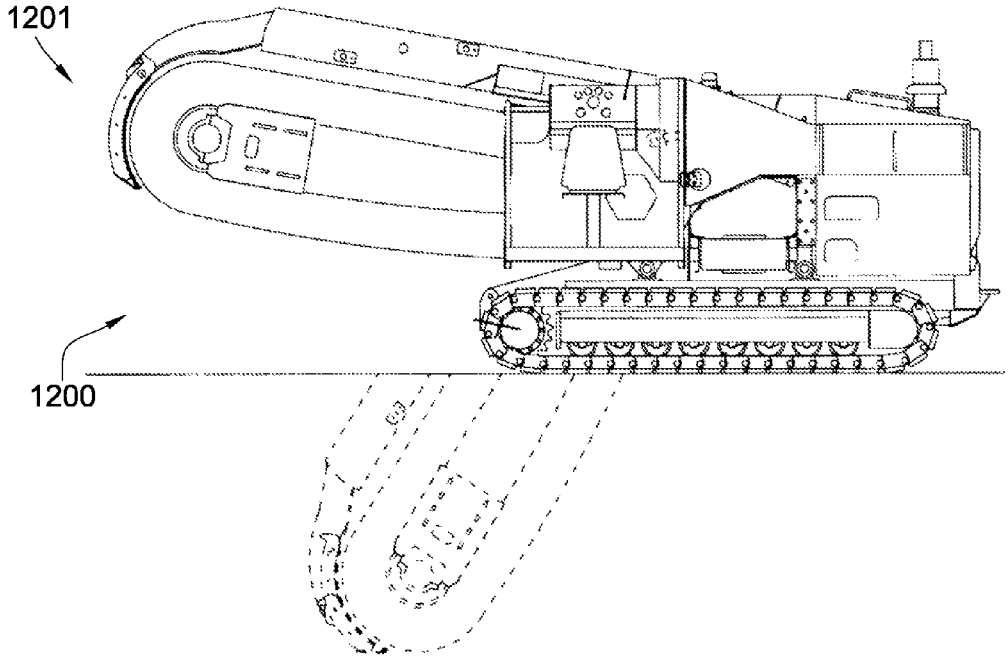
FIG. 13 is a orthogonal diagram of an embodiment of a trenching machine.

Referring now to FIG. 13, the tool may be used in a trenching machine 1200. The tools may be placed on a chain that rotates around an arm 1201.

Whereas the present invention has been described in particular relation to the drawings attached hereto, it should be understood that other and further modifications apart from those shown or suggested herein, may be made within the scope and spirit of the present invention.

What is claimed is:

1. A tip for use in a high impact, wear resistant tool, the tip comprising:

a substrate having a base end and a non-planar interface spaced apart from said base end; and a superhard material bonded to said non-planar interface and having a distal end with an apex spaced apart from said non-planar interface, said superhard material having a thickness of at least 0.100 inches, and said superhard material having a plurality of diamond layers including:

a first diamond layer adjacent to said non-planer interface, said first diamond layer having a first catalyzing material concentration;

a second diamond layer disposed at said distal end of said superhard material, said second diamond layer having a second catalyzing material concentration, said first catalyzing material concentration being greater than said second catalyzing concentration; and a third diamond layer disposed between said first diamond layer and said second diamond layer, said third diamond layer having a third catalyzing material concentration less than said first catalyzing material concentration and greater than said second catalyzing material concentration;

wherein at least one of said first diamond layer, said second diamond layer, and said third diamond layer has an inverted cone geometry, where the inverted cone geometry is inverted with respect to the apex of the superhard material and having a center of curvature distal to said at least one layer.

2. The tip of claim 1, wherein said first diamond layer has a first thickness and said second diamond layer has a second thickness, wherein said first thickness differs from said second thickness.

3. The tip of claim 1, wherein said first diamond layer has a first thickness and said second diamond layer has a second thickness, said first thickness and said second thickness being equal uniform.

4. The tip of claim 1, wherein said first diamond layer has a first thickness and said second diamond layer has a second thickness, wherein said first thickness is between 0.010 inches and 0.100 inches and said second thickness is between 0.010 inches and 0.100 inches.

5. The tip of claim 1, wherein said superhard material has a first volume and said substrate has a second volume and wherein said first volume is 75 percent to 150 percent of said second volume.

6. The tip of claim 1, wherein each of said plurality of diamond layers has a thickness and said substrate has a substrate thickness, wherein said thickness of at least one diamond layer of the plurality of diamond layers is at least as thick as said substrate thickness.

7. The tip of claim 1, wherein said first diamond layer has a catalyzing material concentration between 5 and 10 percent by volume.

8. The tip of claim 1, wherein said second diamond layer has a catalyzing material concentration between 2 and 5 percent by volume.

9. The tip of claim 1, wherein said second diamond layer is leached to remove at least a part of said catalyzing material.

10. The tip of claim 9, wherein said second diamond layer has a catalyzing material concentration of 0 to 1 percent.

11. The tip of claim 1, wherein said superhard material has a substantially pointed geometry with an apex having a 0.050 to 0.125 inch radius.

12. The tip of claim 11, wherein said substantially pointed geometry has a surface extending from said substrate to said apex, wherein said surface is convex.

13. The tip of claim 11, wherein said substantially pointed geometry has a surface extending from said substrate to said apex, wherein said surface is concave.

14. The tip of claim 1, wherein said tip is incorporated in drill bits, percussion drill bits, roller cone bits, shear bits, milling machines, indenters, mining picks, asphalt picks, cone crushers, vertical impact mills, hammer mills, jaw crushers, asphalt bits, chisels, and trenching machines.

15. The tip of claim 1, further comprising a carbide segment, wherein said substrate is bonded to said carbide segment.

16. The tip of claim 15, further comprising a steel body, wherein said carbide segment is brazed or press fit to said steel body.

17. The tip of claim 1, wherein said superhard material is a polycrystalline structure with an average grain size of 1 to 100 microns.

18. The tip of claim 1, wherein said catalyzing material is selected from the group consisting of cobalt, nickel, iron, titanium, tantalum, niobium, and alloys thereof.

19. The tip of claim 1, wherein the non-planar interface has an inverted cone geometry.

20. The tip of claim 1 comprising a plurality of diamond layers with at least one interface possessing an inverted cone geometry with a non-zero value of curvature along its length.

21. A tip for use in a high impact, wear resistant tool, the tip comprising:

a substrate having a base end and a non-planar interface spaced apart from said base end; and a superhard material bonded to said non-planar interface and having a distal end spaced apart from said non-planar interface, said superhard material having a thickness of at least 0.100 inches, and said superhard material having a plurality of diamond layers including:

a first diamond layer adjacent to said non-planer interface and having a first concave face spaced apart from said non-planar interface, said first diamond layer having a first catalyzing material concentration;

a second diamond layer adjacent said first concave face, said second diamond layer having a second catalyzing material concentration and a second concave face spaced apart from said first concave face, said second catalyzing material concentration being less than said first catalyzing material concentration;

a third diamond layer adjacent said second concave face, said third diamond layer having a third catalyzing material concentration and a third concave face spaced apart from said second concave face, said third diamond layer having a third catalyzing material concentration less than said second catalyzing material concentration; and a fourth diamond layer adjacent said third concave face, said fourth diamond layer having a fourth catalyzing material concentration and an apex spaced apart from said third concave face, said fourth diamond layer having a fourth catalyzing material concentration less than said third catalyzing material concentration wherein said concave faces possess an inverted cone geometry with a non-zero value of curvature along their length.

22. The tip of claim 21 wherein the first concave face has a first radius of curvature, the second concave face has a second radius of curvature, and the third concave face has a third radius of curvature, wherein the second radius of curvature is less than the first radius of curvature and the second radius of curvature is greater than the third radius of curvature.

* * * * *